United States Patent [19]

Hachiga

[11] 4,084,567

[45] Apr. 18, 1978

[54] CONTACTLESS IGNITION SYSTEM FOR INTERNAL COMBUSTION ENGINE

[75] Inventor: Takasi Hachiga, Kariya, Japan

[73] Assignee: Nippondenso Co., Ltd., Kariya, Japan

[21] Appl. No.: 664,175

[22] Filed: Mar. 5, 1976

[30] Foreign Application Priority Data

Mar. 14, 1975 Japan ..... 50-31608

[51] Int. Cl.[2] ..... F02P 3/02

[52] U.S. Cl. ..... 123/148 E

[58] Field of Search ..... 123/148 E; 315/20 T

[56] References Cited

U.S. PATENT DOCUMENTS

| | | | |
|---|---|---|---|
| 3,575,154 | 4/1971 | Taylor | 123/148 E |
| 3,605,713 | 9/1971 | LeMasters et al. | 123/148 E |

*Primary Examiner*—Samuel Feinberg

*Attorney, Agent, or Firm*—Cushman, Darby & Cushman

[57] ABSTRACT

A contactless ignition system for an internal combustion engine responds to alternating current ignition signals produced in timed relationship with the engine. A primary winding of an ignition coil and a collector-emitter path of a switching transistor are connected across a direct current power source. A trigger circuit responds each cycle of the alternating current ignition signals for operating the switching transistor conductive and non-conductive in timed relationship with the engine to carry an ignition spark. A primary current limiting circuit, responsive to the voltage potential at the direct current power source, controls the amount of the base current for the switching transistor in accordance with the increased voltage of the power source, to thereby limit the primary current flowing through the primary winding to a predetermined magnitude.

2 Claims, 2 Drawing Figures

CONTACTLESS IGNITION SYSTEM FOR INTERNAL COMBUSTION ENGINE

BACKGROUND OF THE INVENTION

The present invention relates to a contactless ignition system for an internal combustion engine and, more particularly, to an ignition system which includes a provision for limiting primary current for an ignition coil to a predetermined magnitude and establishes control of the amount of the primary current.

To provide an adequate ignition sparking potential to spark plugs of an internal combustion engine, it is necessary that primary current energizing an ignition coil reaches a predetermined magnitude. However, should the primary current reach a magnitude greater than that necessary to provide an adequate sparking potential, a significant waste of battery power results. Further, should the variation of battery voltage affect the primary current for the ignition coil, an unstable sparking operation occurs.

SUMMARY OF THE INVENTION

It is, therefore, an object of the present invention to provide an improved ignition system for an internal combustion engine.

It is another object of the present invention to provide an improved ignition system for an internal combustion engine, which limits primary current for energizing an ignition coil to a predetermined magnitude.

It is an additional object of the present invention to provide an improved ignition system in which the constant voltage is applied to an ignition system irrespective of variations of the power source.

The foregoing and other objects and advantages of the present invention will become apparent from the following description and the accompanying drawings.

DETAILED DESCRIPTION OF THE PREFERRED EMBODIMENT

Figure 1:
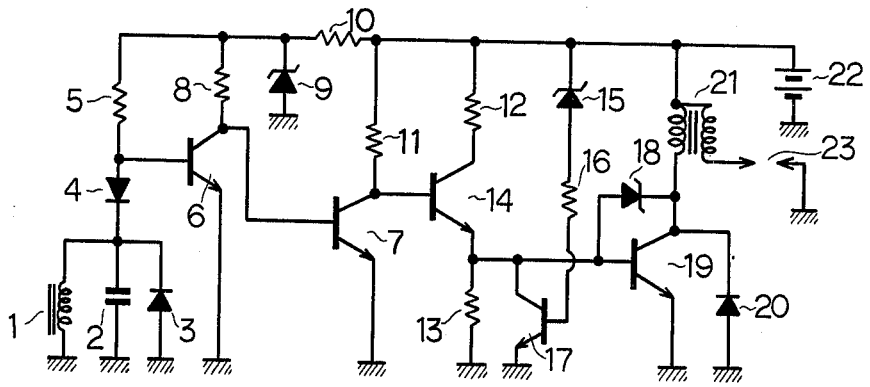
FIG. 1 is a schematic wiring diagram of an ignition system according to the present invention.

Referring now to FIG. 1, a source 1 of alternating current ignition signals is of a conventional magnetic type for producing alternating current with positive and negative half waves in timed relationship with an internal combustion engine (not shown). Connected to the alternating current source 1 are a capacitor 2 for absorbing noise current and a diode 3 for passing the negative half wave.

A direct current power source 22 is a conventional storage battery mounted in a motor vehicle (not shown), to which a current limiting resistor 10 and a zener diode 9 are connected for preventing excessively high voltage from being applied to the associated ignition circuit network. A circuit is connected to the alternating current source 1 and the power source 22 for responding to each cycle of the alternating current ignition signals for operating a switching transistor 19 conductive and nonconductive in timed relationship with the engine, the circuit comprising; a diode 4 with its cathode connected to the source 1, a resistor 5 connected between the anode of the diode 4 and the current limiting resistor 10, a first transistor 6 connected at its base to the anode of the diode 4, a second transistor 7 connected at its base to the collector of the first transistor 6, a third transistor 14 likewise connected at its base to the collector of the second transistor 7, resistors 8, 11 and 12 respectively connected between the collectors of the transistors and the power source 22, and a resistor 13 connected to the emitter of the third transistor 14. The base of the switching transistor 19 is connected to the emitter of the third transistor 14, and the collector-emitter path thereof is connected in series with a primary winding of an ignition coil 21 to the power source 22. The secondary winding of the ignition coil 21 is connected to a spark plug 23 mounted in the engine. Switching transistor protective elements are provided, which includes a zener diode 18 connected between the collector and base of the switching transistor 19 and a diode 20 connected in reversed direction across the collector-emitter path thereof. A primary current limiting circuit is connected to the base of the switching transistor 19 for limiting the primary current flowing through the ignition coil 21. The primary current limiting circuit in the illustrated embodiment comprises a zener diode 15 connected at its cathode to the direct current power source 22, a current limiting resistor 16 connected to the anode of the diode 15, and a control transistor 17 connected at its base to the resistor 16, the collector thereof being connected to the emitter of the transistor 14 as well as the base of the switching transistor 19. The control transistor 17 operates in a manner that the amount of current flowing through the collector-emitter path thereof is increased in accordance with the increase of the base current therefor, and vice versa.

In operation, while the positive half wave is generated at the alternating current source 1 in timed relationship with the engine, the first transistor 6 is carried into the conductive state, to finally drive the third transistor 14 into conduction. Therefore, the switching transistor 19 is operated to permit primary current flow from the power source 22 through the primary winding of the ignition coil 21 and the collector-emitter path thereof, so that the amount of the primary current is controlled in accordance with the base current supplied to the base of the switching transistor 19.

When the negative half wave begins to appear at the alternating current source 1 in timed relationship with the engine, the first transistor 6 is carried into the nonconductive state, to finally drive the third transistor 14 into nonconduction, so that the collector-emitter path of the switching transistor 19 is cut off with the result that the primary current for the ignition coil is abruptly cut off. In the above ignition coil 21, the primary current builds up a magnetic field therein and interruption of the primary current collapses the magnetic field which induces a high ignition potential in the secondary winding of the ignition coil 21, whereby the ignition spark is produced at the spark plug 23 in timed relationship with the engine for igniting air-fuel mixture supplied to a cylinder of the engine.

The primary current limiting circuit operates as follows. While the third transistor 14 is conductive with the power voltage greater than that required for the adequate ignition sparking, the control transistor 17 becomes so operative as to bypass a certain part of the base current for the switching transistor 19 through the collector-emitter path of the control transistor 17. The amount of the bypassed base current is responding to the increased voltage of the power source 22, so that the more the voltage of the power source increases, the larger the amount of the bypassed current becomes, resulting in that the smaller amount of the base current is supplied to the switching transistor 19.

Figure 2:
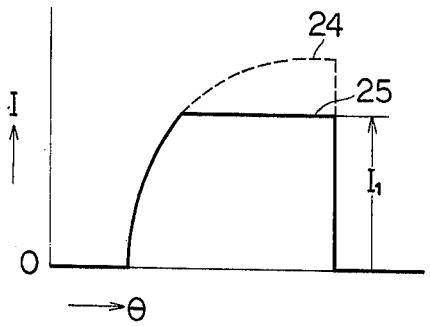
FIG. 2 illustrates a waveform diagram for primary current of an ignition coil.

Accordingly as seen in FIG. 2, the amount of the primary current is limited to a predetermined magnitude as designated by letter $I_1$. In FIG. 2, a dotted line 24 represents the amount of the primary current flowing through the ignition coil 21 when the switching transistor 19 is not affected to limit the current therethrough, while a solid line 25 represents the amount of the primary current according to the present invention.

What is claimed is:

1. An ignition system for an internal combustion engine comprising:

a source of alternating current ignition signals produced in time relationship with the engine;

a direct current power source;

an ignition coil having a primary and a secondary winding;

a switching transistor having a base and a collector-emitter path connected in series with said primary winding;

means for connecting said primary winding and said collector-emitter path across said direct current power source;

means responsive to each cycle of said alternating current ignition signals for operating said switching transistor conductive and nonconductive in timed relationship with the engine; and means, connected to said direct current power source, and said switching transistor, for bypassing a portion of the base current of said switching transistor when the voltage of said direct current power source exceeds a predetermined value thereby limiting the magnitude of primary current flowing through said primary winding to a predetermined magnitude, said bypassing means including a zener diode for sensing the predetermined value of said power source of voltage; and a bypassing transistor for bypassing a portion of the base current of said switching transistor; said zener diode being connected between said power source and the base of said bypassing transistor, and said bypassing transistor having a collector-emitter path connected across the base-emitter path of said switching transistor.

2. A contactless ignition system for an internal combustion engine as in claim 1 wherein said bypassing means further includes a serially connected resistor and zener diode connected between said direct current source and the base of said bypassing transistor for causing said bypassing transistor to conduct when said direct current power source exceeds said predetermined value.

* * * * *